US012669254B2

(12) United States Patent
Kimata et al.

(10) Patent No.: US 12,669,254 B2
(45) Date of Patent: Jun. 30, 2026

(54) AIR CONDITIONING MANAGEMENT SYSTEM AND AIR CONDITIONING MANAGEMENT METHOD

(71) Applicant: Mitsubishi Electric Corporation, Tokyo (JP)

(72) Inventors: Atsushi Kimata, Tokyo (JP); Masanori Nakata, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 317 days.

(21) Appl. No.: 18/263,395

(22) PCT Filed: Jul. 21, 2021

(86) PCT No.: PCT/JP2021/027259
§ 371 (c)(1),
(2) Date: Jul. 28, 2023

(87) PCT Pub. No.: WO2023/002590
PCT Pub. Date: Jan. 26, 2023

(65) Prior Publication Data
US 2024/0117983 A1 Apr. 11, 2024

(51) Int. Cl.
*F24F 11/56* (2018.01)

(52) U.S. Cl.
CPC ..... *F24F 11/56* (2018.01)

(58) Field of Classification Search
CPC .. F24F 11/56; F24F 11/30; F24F 11/58; F24F 11/62; F24F 11/54
See application file for complete search history.

(56) References Cited

U.S. PATENT DOCUMENTS

2009/0139251 A1* 6/2009 Masui ..... F24F 11/64 62/129
2010/0292864 A1* 11/2010 Sung ..... F24F 1/0003 62/126

(Continued)

FOREIGN PATENT DOCUMENTS

CN 205395714 U 7/2016
JP 2015-121392 A 7/2015

(Continued)

OTHER PUBLICATIONS

International Search Report of the International Searching Authority mailed Sep. 21, 2021 in corresponding International Application No. PCT/JP2021/027259 (and English translation).

(Continued)

*Primary Examiner* — Mohammad Ali
*Assistant Examiner* — Vincent W Chang
(74) *Attorney, Agent, or Firm* — Posz Law Group, PLC

(57) ABSTRACT

An air conditioning management system includes: an air conditioning system including a plurality of air conditioning devices which include an outdoor unit, an indoor unit, and a remote control device each capable of performing wired communication; and a communication terminal. Each air conditioning device of the plurality of air conditioning devices includes a transceiver configured to, in response to receiving a request signal requesting device data, transmit device data of the air conditioning device to another air conditioning device or the communication terminal. The communication terminal is capable of performing short-range wireless communication with at least one of the plurality of air conditioning devices, and includes a transmitter configured to transmit by the short-range wireless communication, the request signal to one of the plurality of air conditioning devices, and a receiver configured to receive (Continued)

by the short-range wireless communication, the device data transmitted in response to the request signal.

6 Claims, 14 Drawing Sheets

(56) References Cited

U.S. PATENT DOCUMENTS

| | | | | |
|---|---|---|---|---|
| 2016/0047566 | A1 | 2/2016 | Haga et al. | |
| 2016/0209074 | A1 | 7/2016 | Ito et al. | |
| 2017/0038087 | A1 | 2/2017 | Nabeshima et al. | |
| 2018/0363936 | A1* | 12/2018 | Inoue | F24F 11/61 |
| 2019/0041080 | A1 | 2/2019 | Higuchi et al. | |
| 2023/0328066 | A1* | 10/2023 | Grogg | F24F 11/30 726/2 |

FOREIGN PATENT DOCUMENTS

| | | | |
|---|---|---|---|
| JP | 2017-146065 | A | 8/2017 |
| WO | 2014/171118 | A1 | 10/2014 |
| WO | 2015/037333 | A1 | 3/2015 |
| WO | 2019/004218 | A1 | 1/2019 |
| WO | 2019/038827 | A1 | 2/2019 |
| WO | 2019/186619 | A1 | 10/2019 |

OTHER PUBLICATIONS

Office Action mailed Mar. 27, 2026 in corresponding Chinese Patent Application No. 202180096349.8 (and English machine translation).

* cited by examiner

FIG. 7

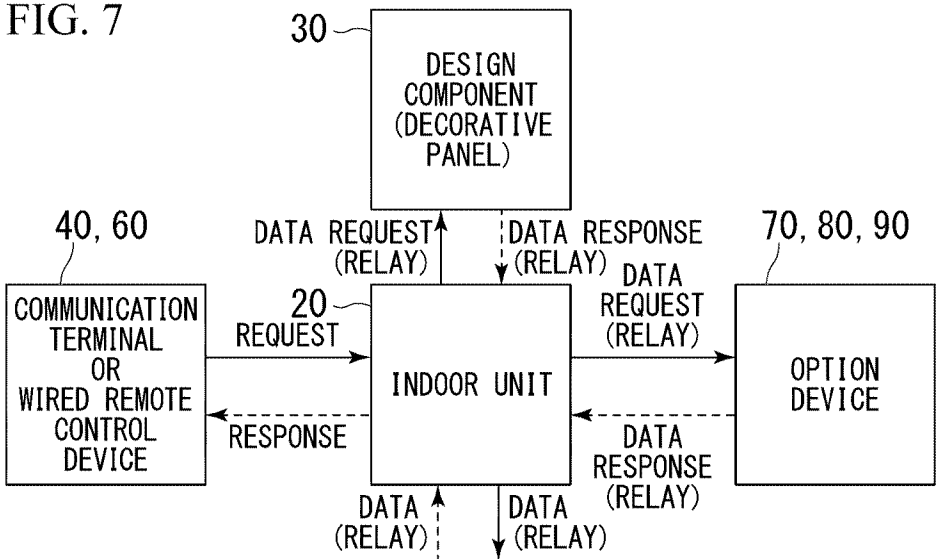

| PATTERN A | PATTERN B | PATTERN C | PATTERN D |
|---|---|---|---|
| DATA A REQUEST | DATA B or C...REQUEST | DATA A,B,C...REQUEST | DATA A,B,C...REQUEST |
| DATA A RESPONSE | DATA B or C...REQUEST (RELAY) | DATA A RESPONSE | DATA B RESPONSE (RELAY) |
| – | DATA B or C...RESPONSE (RELAY) | DATA B REQUEST (RELAY) | DATA C REQUEST (RELAY) |
| – | DATA B or C...RESPONSE | DATA B RESPONSE (RELAY) | DATA B RESPONSE (RELAY) |
| | | DATA B RESPONSE | DATA C RESPONSE (RELAY) |
| | | DATA C REQUEST (RELAY) | DATA A,B,C...RESPONSE |
| | | DATA C RESPONSE (RELAY) | |
| | | DATA C RESPONSE | |

| | |
|---|---|
| PATTERN A | REQUEST DEVICE DATA OF INDOOR UNIT |
| PATTERN B | REQUEST DEVICE DATA OF ONE AIR CONDITIONING DEVICE OTHER THAN INDOOR UNIT |
| PATTERN C | REQUEST DEVICE DATA OF PLURAL AIR CONDITIONING DEVICES (RESPOND EACH TIME) |
| PATTERN D | REQUEST DEVICE DATA OF PLURAL AIR CONDITIONING DEVICES (RESPOND COLLECTIVELY) |

AIR CONDITIONING MANAGEMENT SYSTEM AND AIR CONDITIONING MANAGEMENT METHOD

CROSS REFERENCE TO RELATED APPLICATION

This application is a U.S. national stage application of International Application No. PCT/JP2021/027259, filed on Jul. 21, 2021, the contents of which are incorporated herein by reference.

TECHNICAL FIELD

This disclosure relates to an air conditioning management system and an air conditioning management method.

BACKGROUND

Conventionally, an air conditioning system including air conditioning devices is frequently operated by a user using a remote control device such as a remote controller (hereinafter referred to as "remote controller") connected by wire or wirelessly. The air conditioning devices receive an operation signal from the remote controller and perform a control according to the operation signal. Examples of operations include powering on or off by the user, switching of operating modes, setting by the user of scheduling functions, acquisition of various data and initial setting which are performed by a worker during installation and service, or the like.

Conventionally, for example, as disclosed in Patent Document 1, there is a method for an air conditioning system including air conditioning devices such as an indoor unit, an outdoor unit, and a remote controller, in which various device data that may be requested by a user are previously stored in a storage unit within the remote controller, so that various device data are transmitted in response to a request from a mobile communication terminal or the like. The device data is operation data such as an operating state and an operating history of each air conditioning device such as an indoor unit and an outdoor unit, results of detection by sensors, and data such as various setting information.

CITATION LIST

Patent Document

[Patent Document 1] Japanese Patent Application Publication No. 2017-146065

However, in a case of collectively acquiring device data of various air conditioning devices from a remote controller, or in order to acquire information on a device arbitrarily specified by a user from among various air conditioning devices, for example, the remote controller must be mounted with a large-capacity memory for storing a large amount of device data of various air conditioning devices. Alternatively, there is a method of storing device data in a cloud server via the Internet network, but it is not easy because a device for accessing the Internet network and a setting of the server are required. Further, when multiple models are collectively managed by a cloud server, there is also a problem that the server must be maintained semi-permanently. Therefore, there is a demand to easily acquire device data of air conditioning devices without going through the Internet network.

SUMMARY

The present disclosure has been made in view of the circumstances described above, and one of its objects is to provide an air conditioning management system that can acquire information on each device with a simple configuration.

An air conditioning management system according to the present disclosure includes: an air conditioning system including a plurality of air conditioning devices, the plurality of air conditioning devices including an outdoor unit, an indoor unit, and a remote control device each capable of performing wired communication; and a communication terminal. Each air conditioning device of the plurality of air conditioning devices includes a transceiver configured to, in response to receiving a request signal requesting device data, transmit device data of the air conditioning device to another air conditioning device or the communication terminal. The communication terminal is capable of performing short-range wireless communication with at least one of the plurality of air conditioning devices. The communication terminal includes a transmitter configured to transmit by the short-range wireless communication, the request signal to one of the plurality of air conditioning devices, and a receiver configured to receive by the short-range wireless communication, the device data transmitted in response to the request signal.

Further, an air conditioning management method according to the present disclosure is for an air conditioning system including a plurality of air conditioning devices which includes an outdoor unit, an indoor unit, a remote control device, and an option device connected to at least one of the outdoor unit, the indoor unit, and the remote control device. The air conditioning management method includes: receiving, by a first air conditioning device among the plurality of air conditioning devices, from a communication terminal, a first request signal requesting device data that includes device data of the option device; forwarding, by the first air conditioning device, the first request signal to other air conditioning devices including the option device; receiving, by the first air conditioning device, from each of the other air conditioning devices, the device data of a respective one of the other air conditioning devices; and transmitting, by the first air conditioning device, to the communication terminal, the device data received and the device data of the first air conditioning device.

According to the air conditioning management system and the air conditioning management method of the present disclosure, information on each device can be acquired with a simple configuration.

BRIEF DESCRIPTION OF THE DRAWINGS

FIG. 7 is a diagram showing an example of a device data collection procedure according to the second embodiment.

DETAILED DESCRIPTION

Hereinafter, embodiments will be described with reference to the drawings.

First Embodiment

First, a first embodiment will be described.

[Configuration of Air Conditioning Management System]

Figure 1:
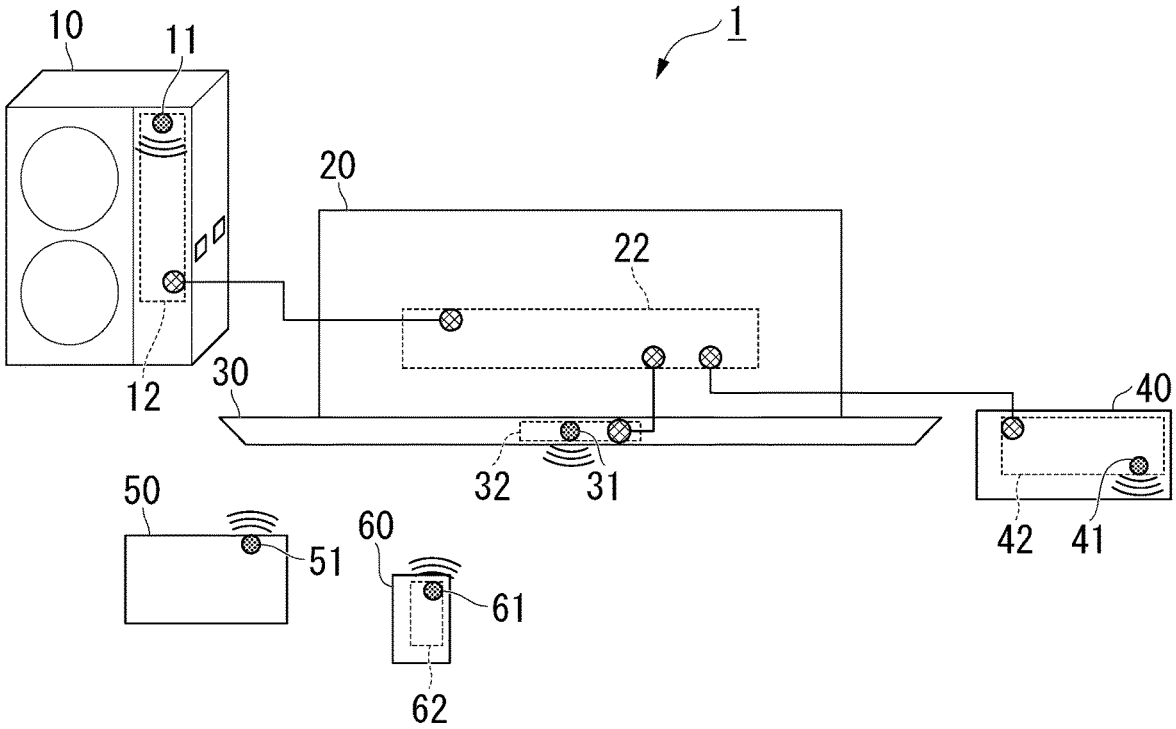
FIG. 1 is a block diagram showing a schematic configuration example of an air conditioning management system according to a first embodiment.

FIG. 1 is a block diagram showing a schematic configuration example of an air conditioning management system according to the present embodiment. An illustrated air conditioning management system 1 includes a plurality of air conditioning devices, as an air conditioning system (air conditioner). Examples of the air conditioning devices include an outdoor unit 10, an indoor unit 20, a design component (decorative panel) 30, a wired remote control device 40, and a wireless remote control device 50.

In the present disclosure, the outdoor unit 10 and the indoor unit 20 have a function of cooling or heating space to be air-conditioned. Further, although this figure shows an example of a ceiling-embedded type indoor unit, examples of the indoor unit 20 may include, regardless of form, a wide variety of indoor units such as a ceiling-suspended type indoor unit, a wall-mounted type indoor unit, and a floor-mounted type indoor unit. The indoor unit 20 is connected to the outdoor unit 10, and is also connected to the design component 30 when there is the design component 30. This is not the case when there is no design component 30. The wired remote control device 40 and the wireless remote control device 50 are remote control devices (remote controllers) capable of remotely controlling operations of the outdoor unit 10 and the indoor unit 20, either by wire or wirelessly.

Figure 2:
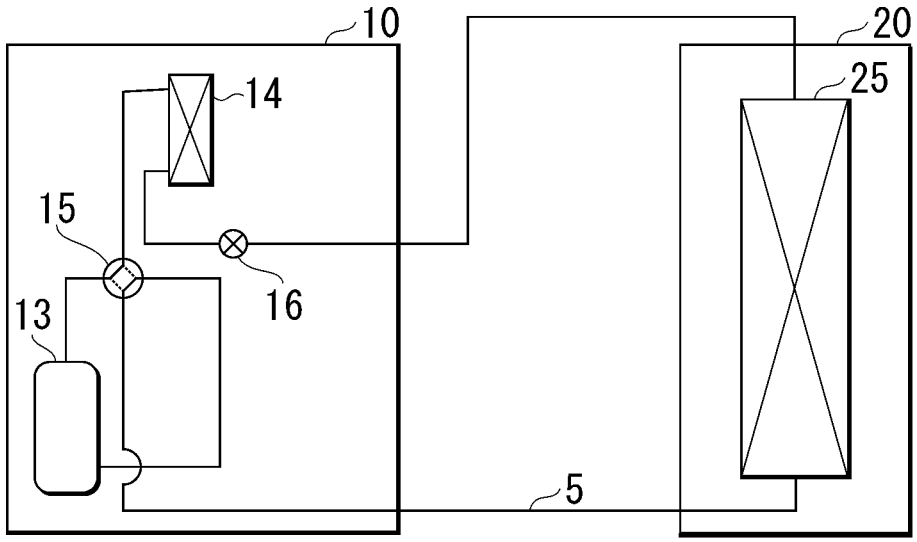
FIG. 2 is a diagram for illustrating a basic operation of air conditioning according to the first embodiment.

Here, a basic operation of air conditioning will be described with reference to FIG. 2. FIG. 2 is a diagram for illustrating the basic operation of air conditioning according to the present embodiment. The outdoor unit 10 and the indoor unit 20 are connected by a refrigerant pipe 5. By switching a four-way valve 15 provided in the outdoor unit 10 to switch a circulation direction of the refrigerant, a heating operation and a cooling operation are switched.

In a case of the heating operation, a gaseous refrigerant compressed by an outdoor unit internal compressor 13 flows through the four-way valve 15 into an indoor unit heat exchanger 25. The refrigerant in the indoor unit heat exchanger 25 exchanges heat with surrounding air to warm the surrounding air. The refrigerant liquefied by the heat exchange flows through an expansion valve 16 into an outdoor unit heat exchanger 14. The refrigerant in the outdoor unit heat exchanger 14 exchanges heat with surrounding air. The refrigerant gasified by the heat exchange returns to the outdoor unit internal compressor 13.

In a case of the cooling operation, a gaseous refrigerant compressed by the outdoor unit internal compressor 13 flows through the four-way valve 15 into the outdoor unit heat exchanger 14. The refrigerant in the outdoor unit heat exchanger 14 exchanges heat with the surrounding air. The refrigerant liquefied by the heat exchange flows through the expansion valve 16 into the indoor unit heat exchanger 25. The refrigerant in the indoor unit heat exchanger 25 exchanges heat with the surrounding air to cool the surrounding air. The refrigerant gasified by the heat exchange returns to the outdoor unit internal compressor 13.

Returning to FIG. 1, the outdoor unit 10, the indoor unit 20, the design component 30, and the wired remote control device 40 are connected by wired communication lines so that each device can perform wired communication. For example, an indoor unit controller 22 included in the indoor unit 20 is connected by wire to each of an outdoor unit controller 12 included in the outdoor unit 10, a design component controller 32 included in the design component 30, and a remote controller 42 included in the wired remote control device 40. Each controller includes a control board and electronic components mounted on the control board. As a result, the outdoor unit 10, the indoor unit 20, the design component 30, and the wired remote control device 40 can mutually exchange information on each device (device data).

Further, at least one device among the outdoor unit 10, the indoor unit 20, the design component 30, and the wired remote control device 40 supports short-range wireless communication. In the illustrated example, the outdoor unit 10, the design component 30, and the wired remote control device 40 support short-range wireless communication. The outdoor unit controller 12 of the outdoor unit 10 includes, as a built-in component, a transceiver 11 that transmits or receives data by short-range wireless communication. The design component controller 32 of the design component 30 includes, as a built-in component, a transceiver 31 that transmits or receives data by short-range wireless communication. The remote controller 42 of the wired remote controller 40 includes, as a built-in component, a transceiver 41 that transmits or receives data by short-range wireless communication. Here, the wireless remote control device 50 is a remote control device originally capable of remotely controlling the operations of the outdoor unit 10 and the indoor unit 20 using short-range wireless communication, and includes, as a built-in component, a transceiver 51 that transmits or receives data by short-range wireless communication.

Further, the air conditioning management system 1 further includes a communication terminal 60. The communication terminal 60 includes a transceiver 61 including a transmitter and a receiver capable of performing short-range wireless communication, and a communication terminal controller 62 including a control board and electronic components including the transceiver 61. The communication terminal 60 can perform short-range wireless communication with at least one of the air conditioning devices. In the illustrated example, the communication terminal 60 can perform short-range wireless communication with the outdoor unit 10, the design component 30, and the wired remote control device 40. For example, the communication terminal 60 is a BLE terminal that supports Bluetooth (registered trademark) Low Energy, such as a smartphone or a personal computer.

Figure 3:
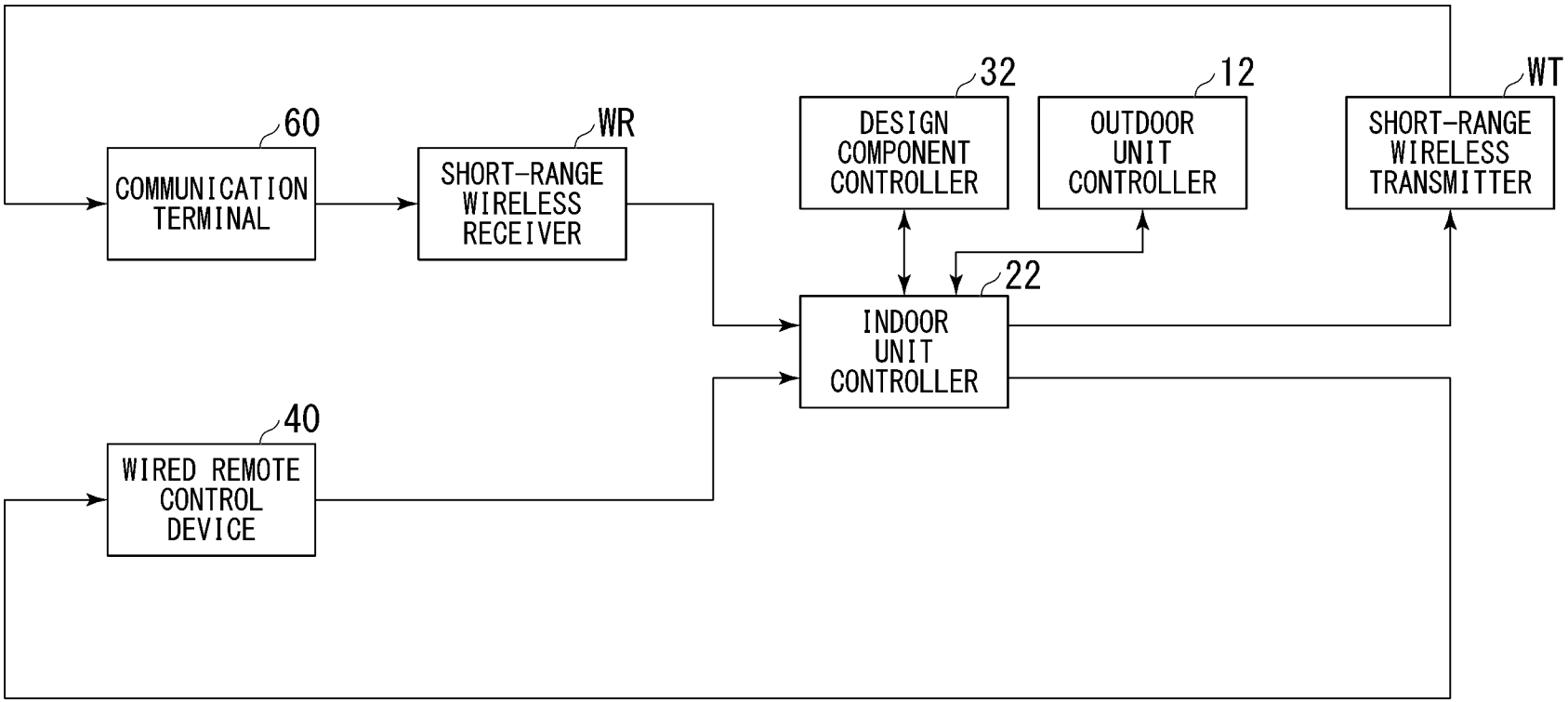
FIG. 3 is a functional block diagram showing an example of a functional configuration of air conditioning devices according to the first embodiment.

FIG. 3 is a functional block diagram showing an example of a functional configuration of the air conditioning devices according to the present embodiment. The communication terminal 60 transmits, by short-range wireless communication, a request signal requesting device data, in response to a user operation or the like. The request signal transmitted from the communication terminal 60 is received by a short-range wireless receiver WR.

The short-range wireless receiver WR is included in at least one of the air conditioning devices. The short-range wireless receiver WR may be included in any of the transceiver 11 built in the outdoor unit 10, the transceiver 31 built in the design component 30, and the transceiver 41 built in the wired remote controller 40.

When the short-range wireless receiving unit WR receives the request signal, the controller of the device that receives the request signal (for example, the design component controller 32 when the transceiver 31 of the design component 30 receives the request signal) forwards the request signal to the indoor unit controller 22 by wired communication. Upon receiving the request signal, based on the received request signal, the indoor unit controller 22 forwards the request signal to each of the design component controller 32 and the outdoor unit controller 12 using wired communication, thereby requesting and collecting device data of each device. Further, the indoor unit controller 22 transmits the device data of the own indoor unit 20 and the device data collected from each of the design component controller 32 and the outdoor unit controller 12 back to the communication terminal 60 as the request source via a short-range wireless transmitter WT. The communication terminal 60 displays the received device data on a display.

The short-range wireless transmitter WT is included in at least one of the air conditioning devices. The short-range wireless transmitter WT may be included in any of the transceiver 11 built in the outdoor unit 10, the transceiver 31 built in the design component 30, and the transceiver 41 built in the wired remote control device 40.

Alternatively, the request signal may be transmitted directly from the wired remote controller 40 to the indoor unit controller 22. For example, in response to a user operation or the like, the wired remote controller 40 transmits a request signal requesting device data to the indoor unit controller 22 by wired communication. The indoor unit controller 22 forwards the request signal received from the wired remote control device 40 to each of the design component controller 32 and the outdoor unit controller 12 using wired communication, thereby collecting device data from each device and transmitting the collected device data and the device data of the own indoor unit 20 back to the wired remote control device 40 as the request source. The wired remote control device 40 displays the received device data on a display.

Here, the device data to be transmitted back to the communication terminal 60 or the wired remote control device 40 as the request source (i.e., the requested device data) is device data of an air conditioning device specified by the communication terminal 60 or the wired remote control device 40 from among the device data of each air conditioning device. The request signal includes information on which air conditioning device's device data is specified as a request target. The number of specified air conditioning devices may be one or more. Further, the specified device data may be data of one item or data of plural items.

Here, a specific example of device data will be explained. Examples of the device data of the outdoor unit 10 include a model name of the outdoor unit 10, a software version of a program that executes the functions of the outdoor unit controller 12, operating data such as an operating state and an operating history of the outdoor unit 10, results of detection by a temperature sensor, and the like. Examples of the device data of the indoor unit 20 include a model name of the indoor unit 20, a software version of a program that executes the functions of the indoor unit controller 22, operating data such as an operating state and an operating history of the indoor unit 20, results of detection by a temperature sensor or a humidity sensor, a function selection list, various setting information, and the like. Examples of the device data of the design component 30 include vane control data, a software version of a program that executes the functions of the design component controller 32, and the like. Further, when the design component 30 is a decorative panel with an automatic lifting filter, the device data of the design component 30 includes position data of the lifting filter, and the like.

Figure 4:
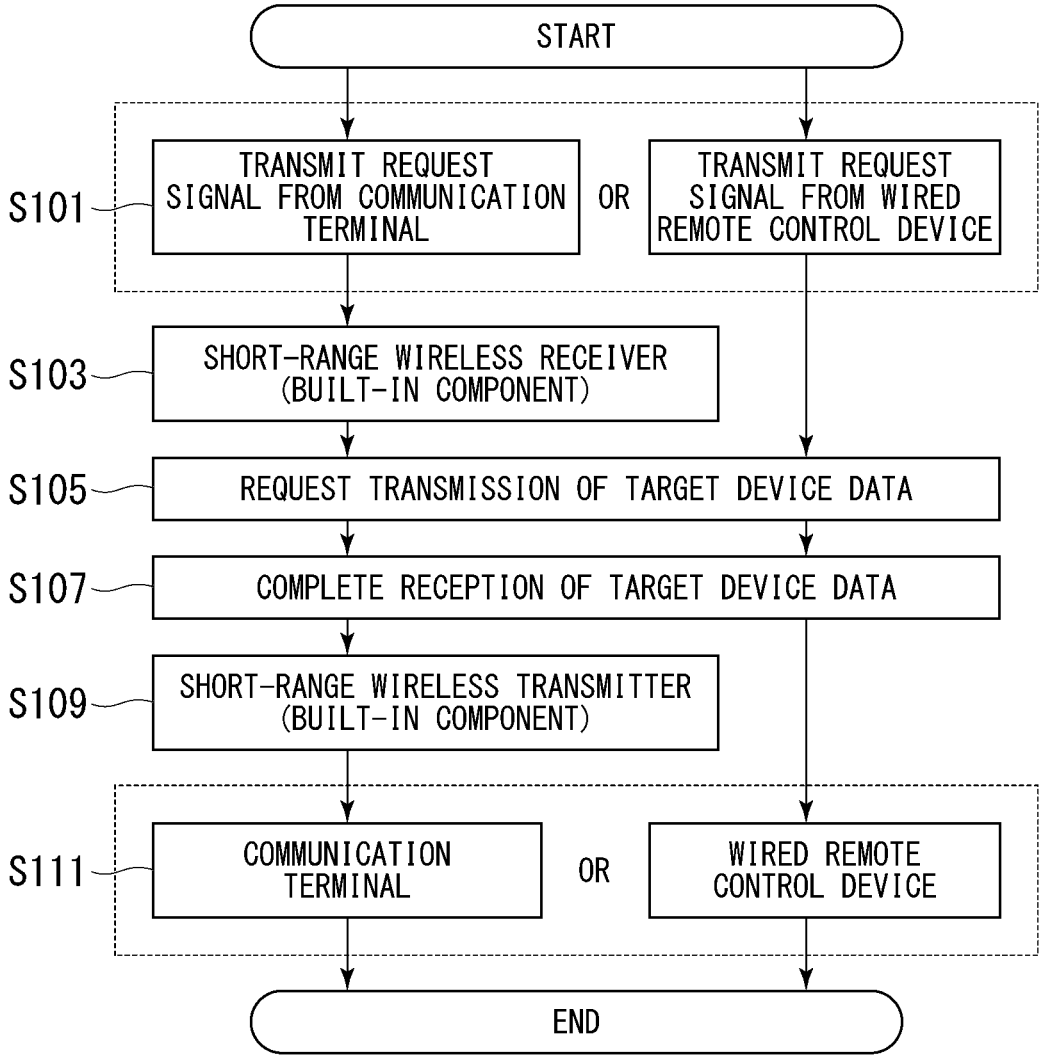
FIG. 4 is a flowchart showing an example of information collection processing for the air conditioning devices according to the first embodiment.

FIG. 4 is a flowchart showing an example of information collection processing for the air conditioning devices according to the present embodiment. The communication terminal 60 or the wired remote control device 40 transmits a request signal (step S101). In the case of the communication terminal 60, the communication terminal 60 transmits the request signal to the short-range wireless receiver WR using short-range wireless communication, and proceeds to step S103. Upon receiving the request signal, the short-range wireless receiver WR forwards the received request signal to the indoor unit 20 (step S103), and proceeds to step S105. In the case of the wired remote control device 40, the wired remote control device 40 transmits the request signal directly to the indoor unit 20 using wired communication, and proceeds to step S105.

Upon receiving the request signal, the indoor unit 20 requests the target air conditioning device to transmit the requested device data (step S105). For example, the indoor unit 20 forwards the received request signal to the air conditioning device as the request target. Then, the indoor unit 20 receives the target device data from the target air conditioning device, and ends the process of collecting device data (step S107).

Further, the indoor unit 20 transmits the collected device data to the request source. When the request source is the communication terminal 60, the indoor unit 20 transmits the collected device data to the short-range wireless transmitter WT using wired communication, and proceeds to step S109. Upon receiving the device data, the short-range wireless transmitter WT transmits the received device data to the communication terminal 60 using short-range wireless communication (step S109), and proceeds to step S111. When the request source is the wired remote control device 40, the indoor unit 20 transmits the collected device data directly to the wired remote control device 40 using wired communication, and proceeds to step S111.

Upon receiving the device data, the communication terminal 60 or the wired remote control device 40 displays the received device data on the display (step S111).

As described above, the air conditioning management system 1 according to the present embodiment includes: an air conditioning system including a plurality of air conditioning devices each capable of performing wired communication; and a communication terminal 60. The plurality of air conditioning devices includes the outdoor unit 10, the indoor unit 20, and the remote control device (e.g., wired remote control device 40 or wireless remote control device 50). Each air conditioning device of the plurality of air conditioning devices is configured to, in response to receiving a request signal requesting device data, transmit device data of the air conditioning device to another air conditioning device or the communication terminal 60 using wired communication or short-range wireless communication. The communication terminal 60 is capable of performing short-range wireless communication with at least one of the plurality of air conditioning devices. The communication terminal 60 is configured to transmit by short-range wireless communication, the request signal (for example, one request signal) to one of the plurality of air conditioning devices, and receive by short-range wireless communication, the device data transmitted in response to the request signal.

As a result, according to the air conditioning management system 1, the communication terminal 60 can acquire from at least one air conditioning device in the air conditioning system, data of the air conditioning devices such as the outdoor unit 10 and the indoor unit 20, using short-range wireless communication without using a cloud server or an Internet network. Therefore, information on each device can be acquired with a simple configuration. Further, according to the present embodiment, there is no need to install a large-capacity memory for storing information on each device in the remote controller (remote control device), thereby enabling a reduction in the production cost and the mounting space for components to be mounted.

Among the plurality of air conditioning devices, the indoor unit 20 (an example of a first air conditioning device) that receives the request signal transmitted from the communication terminal 60 is configured to forward the request signal to another air conditioning device. For example, the indoor unit 20 receives the request signal using wired communication from an air conditioning device (for example, the design component 30) that has received by short-range wireless communication, the request signal transmitted from the communication terminal 60, and forwards the request signal to another air conditioning device using wired communication. The other air conditioning device (for example, the outdoor unit 10, the design component 30, etc.) is configured to transmit device data of the other air conditioning device to the indoor unit 20, in response to receiving the request signal forwarded from the indoor unit 20. The indoor unit 20 is configured to transmit the device data received and the device data of the indoor unit 20 to the communication terminal 60. For example, the indoor unit 20 transmits the device data using wired communication to the air conditioning device (for example, the design component 30) that has received the request signal, thereby allowing the air conditioning device (for example, the design component 30) to transmit the device data to the communication terminal 60 using short-range wireless communication.

As a result, according to the air conditioning management system 1, in response to a request from the communication terminal 60, the indoor unit 20 can transmit the information on another air conditioning device and the information on the indoor unit 20 back to the communication terminal 60 via at least one air conditioning device that supports short-range wireless communication in the air conditioning system. Therefore, information on each device can be acquired with a simple configuration.

Second Embodiment

Next, a second embodiment will be described.

Option devices may be added to the air conditioning devices according to the first embodiment.

Figure 5:
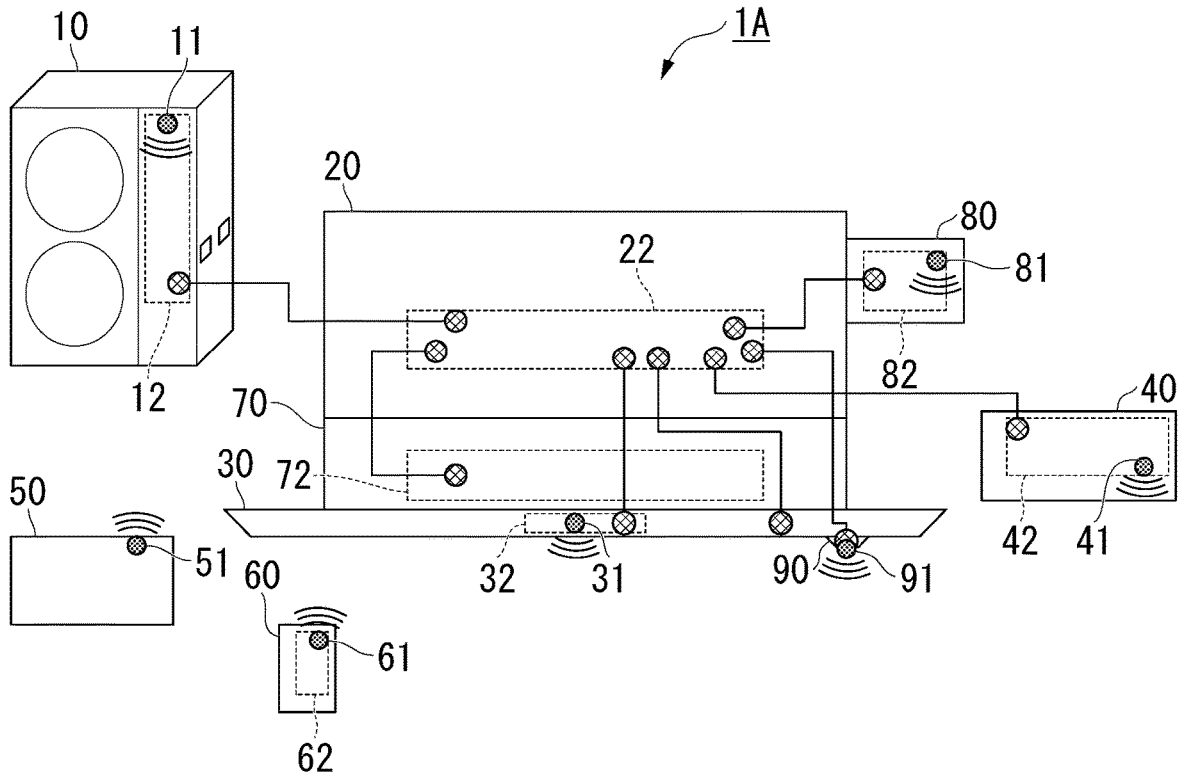
FIG. 5 is a block diagram showing a schematic configuration example of an air conditioning management system according to a second embodiment.

FIG. 5 is a block diagram showing a schematic configuration example of an air conditioning management system according to the present embodiment. Compared with the air conditioning management system 1 in FIG. 1, an illustrated air conditioning management system 1A further includes, as the air conditioning system (air conditioner), three types of option devices 70, 80, and 90 connected to the indoor unit 20 or the design component 30.

For example, the option device 70 is an expansion unit having an expansion board connected to the indoor unit 20. The option device 70 includes an option device controller 72 and is connected to the indoor unit controller 22 of the indoor unit 20 via a wired communication line. The indoor unit controller 22 includes a control board (expansion board), electronic components, and the like.

For example, the option device 80 is a humidifier connected to the indoor unit 20. The option device 80 includes an option device controller 82 and is connected to the indoor unit controller 22 of the indoor unit 20 via a wired communication line. Further, the option device 80 supports short-range wireless communication, and the option device controller 82 includes, as a built-in component, a transceiver 81 that transmits or receives data by short-range wireless communication.

For example, the option device 90 is a human sensor attached to the design component 30. The option device 90 is connected to the indoor unit controller 22 of the indoor unit 20 via a wired communication line. Further, the option device 90 supports short-range wireless communication and includes, as a built-in component, a transceiver 91 that transmits or receives data by short-range wireless communication.

Here, the option devices 70, 80, and 90 are examples of option devices, and are not limited to these.

Figure 6:
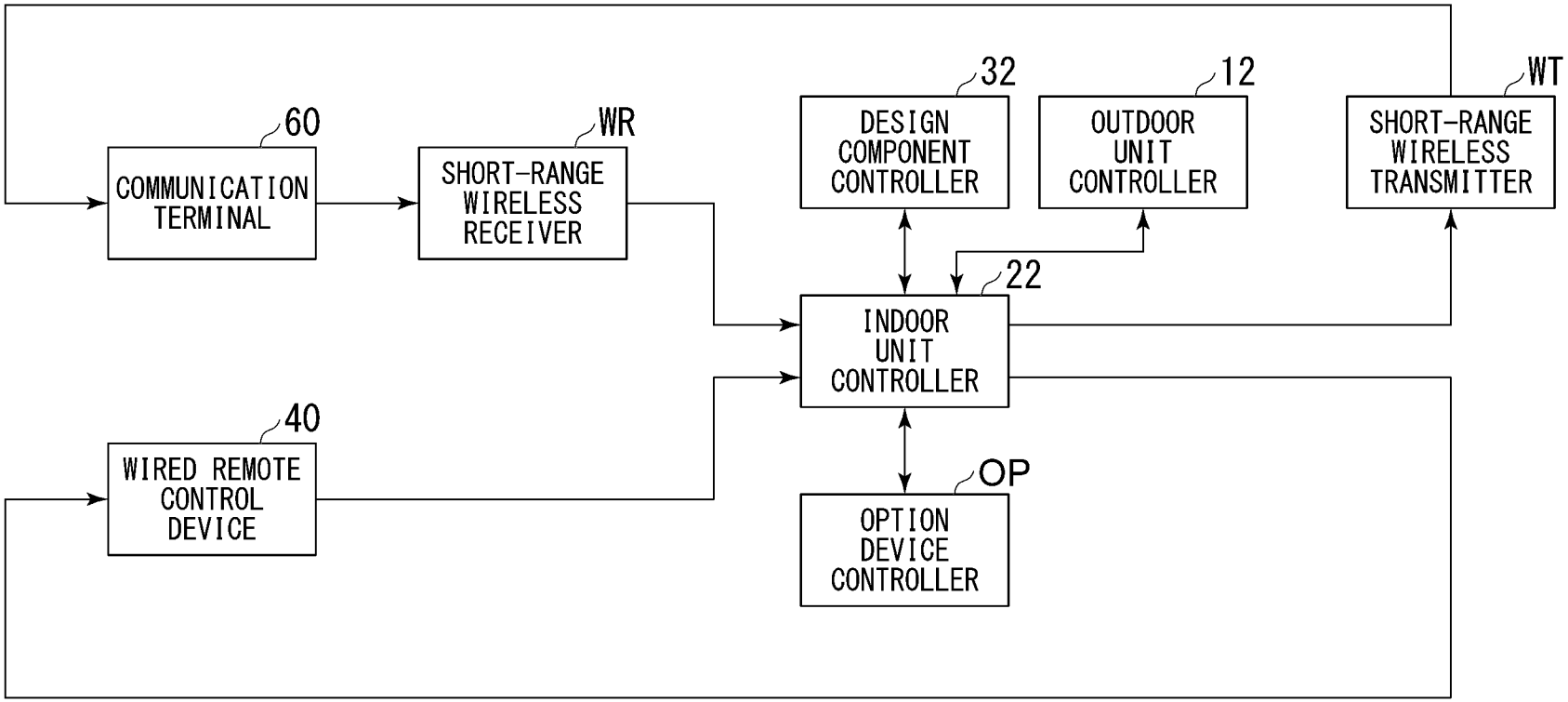
FIG. 6 is a functional block diagram showing an example of a functional configuration of air conditioning devices according to the second embodiment.

FIG. 6 is a functional block diagram showing an example of a functional configuration of the air conditioning devices according to the present embodiment. The functional configuration shown in FIG. 6 differs from the functional configuration shown in FIG. 3 in that the indoor unit controller 22 can further collect device data from an option device controller OP using wired communication. The option device controller OP represents the respective controllers of the option devices 70, 80, and 90. Further, the short-range wireless receiver WR and the short-range wireless transmitter WT may be included in any of the transceiver 11 built in the outdoor unit 10, the transceiver 31 built in the design component 30, and the transceiver 41 built in the wired remote controller 40, and may also be included in any of the transceiver 81 built in the option device 80 and the transceiver 91 built in the option device 90.

A flowchart of information collection processing for the air conditioning devices according to the present embodiment is the same as the flowchart shown in FIG. 4, except that the requested device data further includes device data (component data) of the option devices 70, 80, and 90. In response to a request signal, the indoor unit controller 22 collects the requested device data of the target air conditioning device from among the air conditioning devices including the option devices. Therefore, in response to a user operation, or the like, the communication terminal 60 or the wired remote control device 40 transmits a request signal requesting device data by short-range wireless communication, and thereby can acquire and display the device data of the option devices 70, 80, and 90, in addition to the device data of the outdoor unit 10, the indoor unit 20, and the design component 30.

Next, a procedure for collecting device data will be described.

FIG. 7 is a diagram showing an example of a device data collection procedure according to the present embodiment. When a request signal is transmitted from the communication terminal 60 or the wired remote control device 40 to request device data of each air conditioning device, the indoor unit 20 relays the request for device data to the outdoor unit 10, the design component 30, and the option devices 70, 80, and 90. The indoor unit 20 relays and receives responses of the device data from the outdoor unit 10, the design component 30, and the option devices 70, 80, and 90, and relays the received device data to the communication terminal 60 or the wired remote control device 40. Here, four types of collection procedures, which are pattern A, pattern B, pattern C, and pattern D, will be described.

(Pattern A) When the requested item is the device data of the indoor unit 20 (data A) alone, upon receiving a request signal from the communication terminal 60 or the wired remote control device 40, the indoor unit 20 can transmit to the communication terminal 60 or the wired remote control device 40, the device data (data A) corresponding to the requested item without transmitting the request signal to another air conditioning device (response).

(Pattern B) When the requested item is device data of one device other than the indoor unit 20, the indoor unit 20 requests the device data from the one air conditioning device (any one of the outdoor unit 10, the design component 30, and the option devices) as the request target (relay). For example, upon receiving a request signal from the communication terminal 60 or the wired remote control device 40, the indoor unit 20 transmits the request signal to the air conditioning device (for example, the outdoor unit 10 or an option device) as the request target. Then, the indoor unit 20 acquires a response of the device data (data B or data C) from the requested air conditioning device (for example, the outdoor unit 10 or an option device) (relay), and transmits the acquired device data (data B or data C) to the communication terminal 60 or the wired remote control device 40 (response).

(Pattern C) When the requested items cover plural air conditioning devices, the indoor unit 20 requests plural pieces of device data from one or plural air conditioning devices as the request targets (relay). For example, upon receiving a request signal from the communication terminal 60 or the wired remote control device 40, the indoor unit 20 transmits the request signal to one or plural air conditioning devices, and transmits the device data collected from each air conditioning device to the communication terminal 60 or the wired remote control device 40 (response). For example, it is assumed that device data of the indoor unit 20 (data A), device data of the outdoor unit 10 (data B), and device data of an option device (data C) are requested. First, the indoor unit 20 transmits the device data (data A) stored by the indoor unit 20 itself to the communication terminal 60 or the wired remote control device 40 (response). Then, the indoor unit 20 requests the device data (data B) of the outdoor unit 10 from the outdoor unit 10 (relay), thereby acquires a response of the device data (data B) from the outdoor unit 10 (relay), and transmits the acquired device data (data B) to the communication terminal 60 or the wired remote control device 40 (response). Subsequently, the indoor unit 20 requests the device data (data C) of the option device from the option device 70 (or 80 or 90) (relay), thereby acquires a response of the device data (data C) from the option device (relay), and transmits the acquired device data (data C) to the communication terminal 60 or the wired remote control device 40 (response). In this way, in the case of pattern C where the requested items cover plural air conditioning devices, device data is collected and transmitted back each time a request is made.

(Pattern D) Similar to pattern C, this is a case where the requested items cover plural air conditioning devices, but this is a procedure for responding collectively for the plural requested items, instead of responding each time. After waiting for a response of the device data (data B) from the outdoor unit 10 and a response of the device data (data C) from the option device, the indoor unit 20 collectively transmits to the communication terminal 60 or the wired remote control device 40, the device data (data A) stored by the indoor unit 20 itself, the device data (data B) acquired from the outdoor unit 10, and the device data (data C) acquired from the option device (response).

Here, if the process related to the option device is removed from the device data collection procedure shown in FIG. 7, a device data collection procedure for the air conditioning management system 1 of the first embodiment can be obtained.

Next, a screen for selecting a request item, which is displayed on the communication terminal 60 or the wired remote control device 40, will be described.

Figure 8:
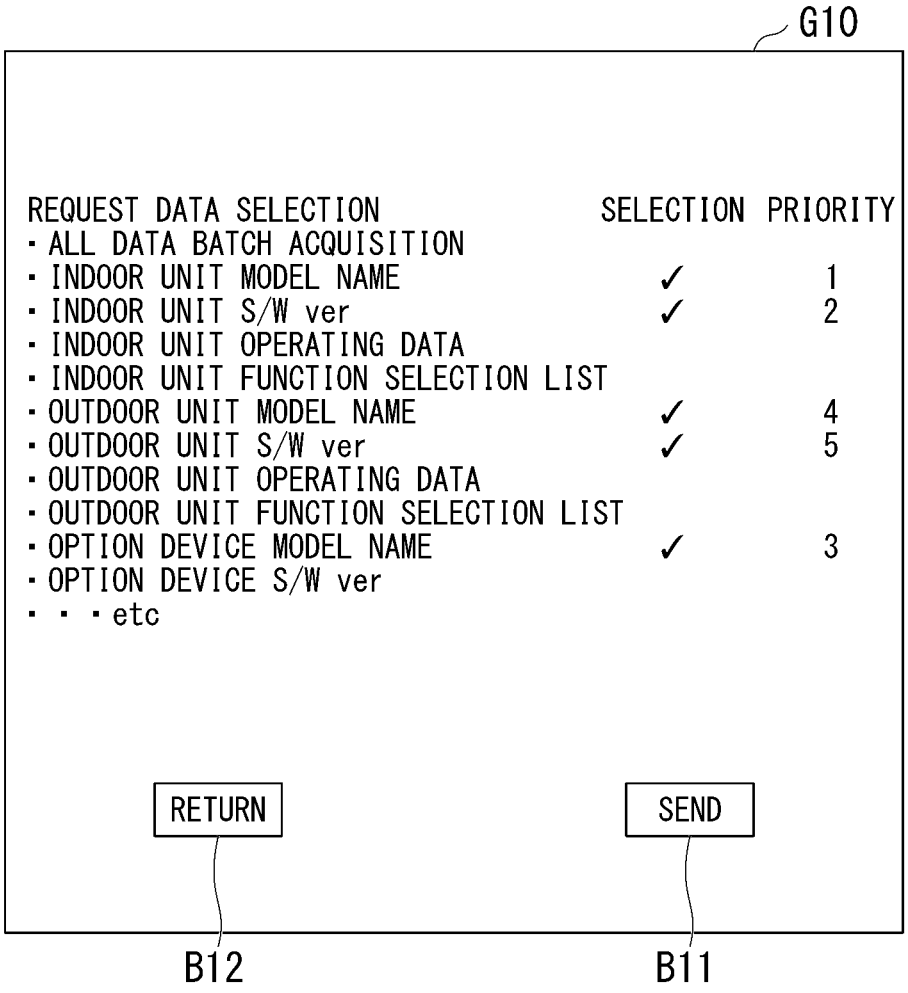
FIG. 8 is a diagram showing an example of a request item selection screen according to the second embodiment.

FIG. 8 is a diagram showing an example of a request item selection screen according to the present embodiment. Request items selectable by a user are displayed on an illustrated selection screen G10. Regarding the request items, all data batch acquisition, indoor unit model name, indoor unit software version (S/W ver), indoor unit operating data, and so on are displayed as "request data selection." A check mark is displayed on the request item selected by a user operation.

The user can specify device data to be requested by selecting a request item. For example, the user can make a detailed selection for each request item or make a collective selection. Further, when the user makes a selection for each request item, the user can select one request item and can also select plural request items. Here, when selecting plural request items, processing priorities can be assigned. Device data are collected and displayed in order of priorities.

When the user selects a request item and operates a send button B11, the communication terminal 60 or the wired remote control device 40 transmits a request signal requesting the selected request item. Further, after the transmission, for example, a cancel button is displayed, making it possible to select interruption of the processing. A return button B12 is a button that is operated to stop selecting a request item.

Here, the example of the request item selection screen shown in FIG. 8 is for reference only, and the design of the selection screen is not limited to this. Further, if the request items related to option devices are removed from the request items shown in FIG. 8, a request item selection screen for the air conditioning management system 1 of the first embodiment can be obtained.

As described above, in the air conditioning management system 1A according to the present embodiment, the plurality of air conditioning devices further include option devices 70, 80, and 90. The communication terminal 60 can transmit a request signal requesting device data including data of the option devices 70, 80, and 90, in addition to the device data of the outdoor unit 10, the indoor unit 20, the design component 30, and the like. For example, the indoor unit 20 (an example of a first air conditioning device) that receives the request signal, among the plurality of air conditioning devices, is configured to forward the request signal to other air conditioning devices including the option devices 70, 80, and 90. For example, the indoor unit 20 is configured to receive the request signal using wired communication from the air conditioning device (for example, the design component 30) that has received using short-range wireless communication, the request signal transmitted from the communication terminal 60, and forward using wired communication, the request signal to the other air conditioning devices including the option devices 70, 80, and 90. Each of the other air conditioning devices including the option devices 70, 80, and 90 is configured to transmit the device data of a respective one of the other air conditioning devices to the indoor unit 20, in response to receiving the request signal forwarded from the indoor unit 20. The indoor unit 20 is configured to transmit to the communication terminal 60, the device data received and the device data of the indoor unit 20. For example, the indoor unit 20 transmits the device data to the air conditioning device (for example, the design component 30) using wired communication, so that the air conditioning device (for example, the design component 30) that supports short-range wireless communication transmits the device data to the communication terminal 60 using short-range wireless communication.

As a result, according to the air conditioning management system 1A, the communication terminal 60 can acquire from at least one air conditioning device in the air conditioning system, not only the device data of the air conditioning devices such as the outdoor unit 10 and the indoor unit 20, but also the device data of the option devices connected to them, using short-range wireless communication without using a cloud server or an Internet network. Therefore, information on each device can be acquired with a simple configuration.

Further, the indoor unit 20 (an example of a first air conditioning device) that has received the request signal, among the plurality of air conditioning devices, may forward the request signal sequentially to the other air conditioning devices. For example, the indoor unit 20 may receive the request signal using wired communication from the air conditioning device (for example, the design component 30) that has received by short-range wireless communication, the request signal transmitted from the communication terminal 60, and forward the request signal to the other air conditioning devices using wired communication. In response to the request signal sequentially forwarded from the indoor unit 20, each of the other air conditioning devices (for example, the outdoor unit 10, the design component 30, the option devices 80 and 90, etc.) is configured to transmit to the indoor unit 20, the device data of a respective one of the other air conditioning devices. The indoor unit 20 is configured to sequentially transmit to the communication terminal 60, the device data received and the device data of the indoor unit 20. For example, the indoor unit 20 sequentially transmits the device data using wired communication to the air conditioning device (for example, the design component 30) that has received the request signal, so that the air conditioning device (for example, the design component 30) sequentially transmits the device data to the communication terminal 60 using short-range wireless communication.

As a result, according to the air conditioning management system 1A, for example, in response to the communication terminal 60 transmitting a one-time request signal requesting device data of a plurality of air conditioning devices, the indoor unit 20 can transmit the request signal sequentially to the other air conditioning devices to collect the device data, and transmit the collected device data sequentially to the communication terminal 60. Therefore, it is convenient for the user.

Here, instead of sequentially transmitting the device data received and the device data of the indoor unit 20 to the communication terminal 60, the indoor unit 20 may collectively transmit the device data received and the device data of the indoor unit 20 to the communication terminal 60.

As a result, according to the air conditioning management system 1A, for example, in response to the communication terminal 60 transmitting a one-time request signal requesting device data of a plurality of air conditioning devices, the indoor unit 20 can transmit the request signal sequentially to the other air conditioning devices to collect the device data, and transmit the collected device data collectively to the communication terminal 60. Therefore, it is convenient for the user.

Further, the communication terminal 60 is configured to transmit a request signal including specification information specifying an air conditioning device whose device data is to be acquired, among the plurality of air conditioning devices. Among the plurality of air conditioning devices, the indoor unit 20 (an example of a first air conditioning device) that has received the request signal is configured to forward the request signal to the air conditioning device (for example, the outdoor unit 10) specified by the specification information. The air conditioning device (for example, the outdoor unit 10) specified by the specification information is configured to transmit the device data of the own air conditioning device to the indoor unit 20, in response to receiving the request signal forwarded from the indoor unit 20. The indoor unit 20 is configured to transmit the device data received to the communication terminal 60.

As a result, according to the air conditioning management system 1A, it is possible to specify and acquire from the communication terminal 60, information that the user wants to check among the plurality of information on the outdoor unit 10, the indoor unit 20, the option devices, and the like in the air conditioning system. Therefore, it is convenient. For example, the user can select and acquire information on each device, and can also collectively acquire the information.

Further, the communication terminal 60 may transmit the request signal with priorities of device data to be acquired. Among the plurality of air conditioning devices, the indoor unit 20 (an example of a first air conditioning device) that has received the request signal is configured to sequentially forward the request signal to a plurality of other air conditioning devices according to the priorities. Each of the plurality of other air conditioning devices is configured to transmit the device data of a respective one of the plurality of other air conditioning devices to the indoor unit 20, in response to receiving the request signal forwarded from the indoor unit 20. The indoor unit 20 is configured to transmit to the communication terminal 60, the device data received and the device data of the communication terminal 60 according to the priorities.

As a result, according to the air conditioning management system 1A, it is possible to acquire from the communication terminal 60, information with priorities which the user wants to check among the information on the outdoor unit 10, the indoor unit 20, the option devices, and the like in the air conditioning system. Therefore, it is convenient because the user can first check the information on the device which the user wants to check.

Further, in the air conditioning management system 1A according to the present embodiment, the plurality of air conditioning devices may include option devices (for example, option devices 80 and 90) capable of performing short-range wireless communication. For example, the communication terminal 60 is configured to transmit a request signal requesting device data that includes data of the option device 80 or the option device 90. The option device 80 or option device 90 that has received this request signal may transmit to the communication terminal 60, the device data of the own option device and the device data of the other air conditioning devices, in response to receiving the request signal. For example, the option device 80 or the option device 90 that has received using short-range wireless communication, the request signal transmitted from the communication terminal 60 is configured to forward the request signal to other air conditioning devices than the option device 80 or the option device 90, in response to receiving the request signal. Each of the other air conditioning devices is configured to transmit the device data of a respective one of the other air conditioning devices to the option device 80 or the option device 90, in response to receiving the request signal forwarded from the option device 80 or the option device 90. Then, the option device 80 or the option device 90 is configured to transmit the device data received and the device data of the own option device to the communication terminal 60 using short-range wireless communication.

In this way, by the communication terminal 60 requesting device data from an option device, the option device may collect the device data of each air conditioning device and transmit the collected device data back to the communication terminal 60. As a result, according to the air conditioning management system 1A, the communication terminal 60 can acquire from at least one option device in the air conditioning system, device data of the air conditioning devices such as the outdoor unit 10 and the indoor unit 20, and device data of option devices connected to those air conditioning devices, using short-range wireless communication without using a cloud server or an Internet network. Therefore, information on each device can be acquired with a simple configuration.

Third Embodiment

Next, a third embodiment will be described.

Figure 9:
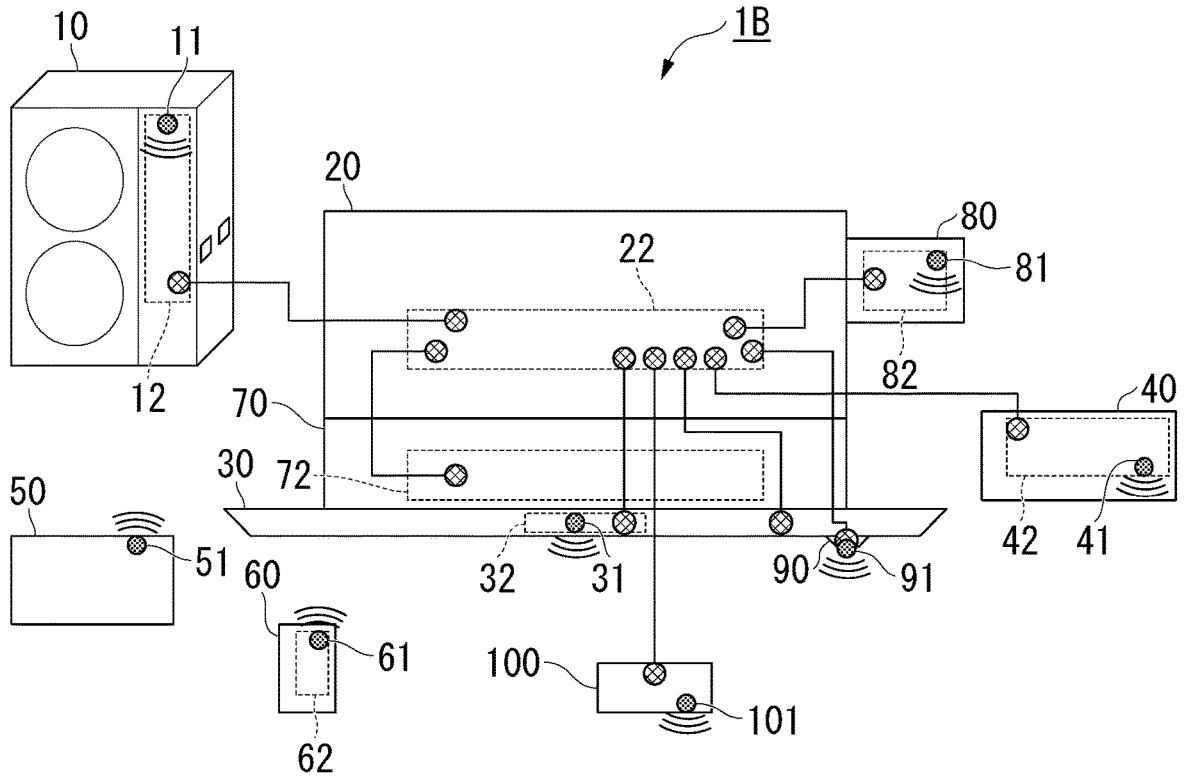
FIG. 9 is a block diagram showing a schematic configuration example of an air conditioning management system according to a third embodiment.

FIG. 9 is a block diagram showing a schematic configuration example of an air conditioning management system according to the present embodiment. Compared with the air conditioning management system 1A of FIG. 5, an illustrated air conditioning management system 1B further includes a system logger 100 as an option device.

The system logger 100 can collect and store device data from each air conditioning device. Further, the system logger 100 can perform both periodical collection of device data and collection of current device data.

The system logger 100 includes, as a built-in component, a transceiver 101 that transmits or receives data by short-range wireless communication. The system logger 100 can communicate with air conditioning devices that support short-range wireless communication, and collects and stores device data of the outdoor unit 10, the indoor unit 20, the design components 3, the option devices 70, 80, and 90, and the like. Further, the system logger 100 is communicatively connected by wire to the indoor unit controller 22 of the indoor unit 20. The system logger 100 can also acquire using wired communication, and store, the device data collected by the indoor unit 20.

In the air conditioning management system 1, after receiving a request signal regardless of whether or not the reception is made via the indoor unit 20, the system logger 100 transmits to the communication terminal 60 or the wired remote control device 40, the latest requested device data among the device data already collected and stored in the system logger 100 (response). This reduces time loss in acquiring information from the air conditioning devices.

Figure 10:
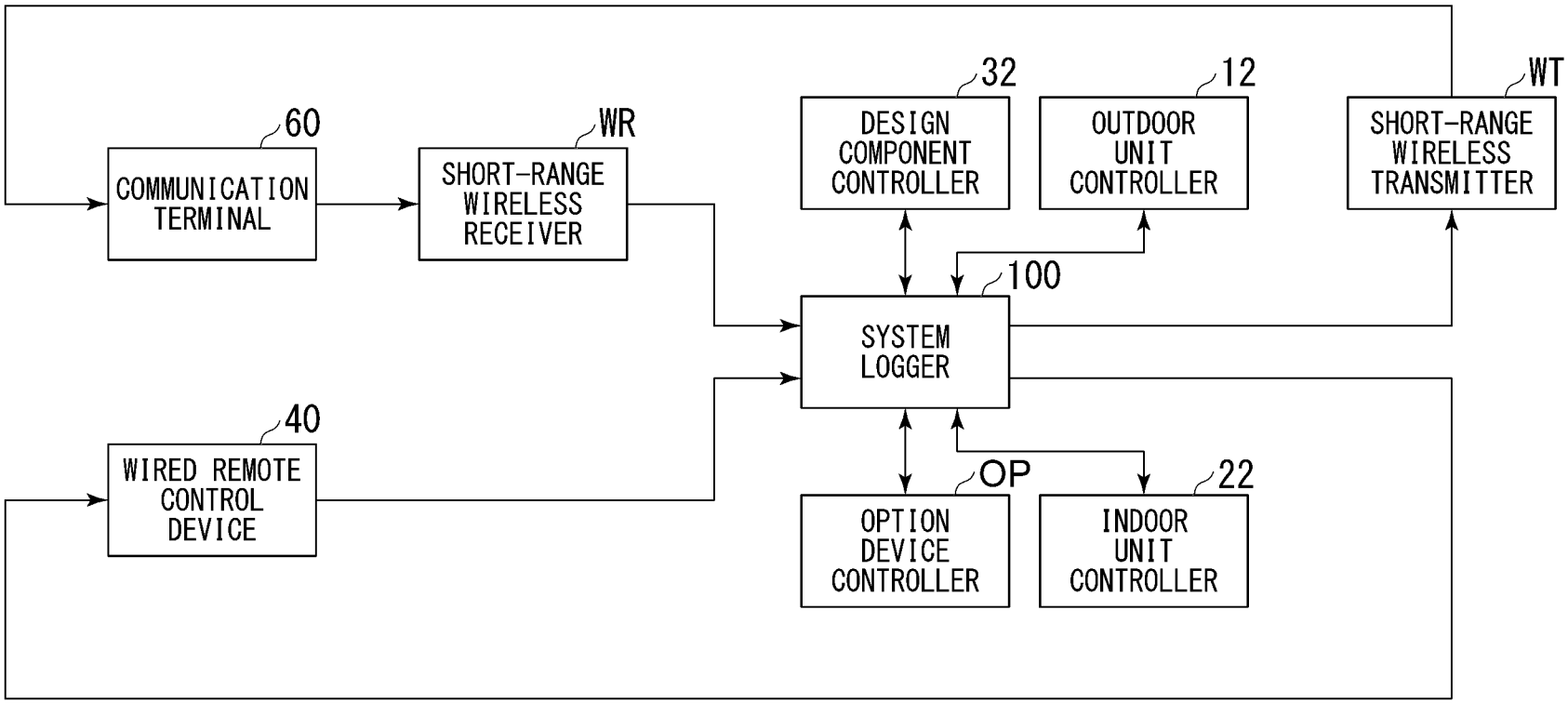
FIG. 10 is a functional block diagram showing an example of a functional configuration of air conditioning devices according to the third embodiment.

FIG. 10 is a functional block diagram showing an example of a functional configuration of the air conditioning devices according to the present embodiment. The functional configuration shown in FIG. 10 differs from the functional configuration shown in FIG. 6 in that the system logger 100, instead of the indoor unit controller 22 of the indoor unit 20, collects device data from each air conditioning device and responds to a request from the communication terminal 60 or the wired remote control device 40.

In response to a user operation or the like, the communication terminal 60 transmits, by short-range wireless communication, a request signal requesting device data. The request signal transmitted from the communication terminal 60 is received by the short-range wireless receiver WR. For example, the short-range wireless receiver WR is included in the transceiver 101 built in the system logger 100. Here, the short-range wireless receiver WR may be included in any of the transceiver 11 built in the outdoor unit 10, the transceiver 31 built in the design component 30, the transceiver 41 built in the wired remote control device 40, the transceiver 81 built in the option device 80, and the transceiver 91 built in the option device 90. Further, the short-range wireless receiver WR may relay and forward the request signal to the system logger 100.

Further, in response to a user operation or the like, the wired remote control device 40 transmits a request signal requesting device data to the system logger 100 by wired communication via the indoor unit controller 22. Here, the wired remote control device 40 may transmit the request signal to the system logger 100 using short-range wireless communication.

The system logger 100 collects device data from the outdoor unit controller 12, the indoor unit controller 22, the design component controller 32, and the option device controller OP, and stores the collected device data. Here, the system logger 100 may collect device data from the outdoor unit controller 12, the design component controller 32 and the option device controller OP via the indoor unit controller 22. For example, the system logger 100 periodically collects device data from each air conditioning device and store the collected device data. Further, in response to receiving a request signal from the communication terminal 60 or the wired remote control device 40, the system logger 100 can collect the device data at the time of the reception and store the collected device data.

Upon receiving a request signal from the communication terminal 60, the system logger 100 transmits the latest requested device data among the stored collected device data to the communication terminal 60 via the short-range wireless transmitter WT (response). For example, the short-range wireless transmitter WT is included in the transceiver 101 built in the system logger 100. Here, the short-range wireless transmitter WT may be included in any of the transceiver 11 built in the outdoor unit 10, the transceiver 31 built in the design component 30, and the transceiver 41 built in the wired remote control device 40. Further, the short-range wireless transmitter WT may relay the device data transmitted from the system logger 100 to the communication terminal 60 (response). The communication terminal 60 displays the received device data on the display.

Further, upon receiving a request signal from the wired remote control device 40, the system logger 100 transmits to the wired remote control device 40 by wired communication via the indoor unit controller 22, the latest requested device data among the stored collected device data (response). Here, the system logger 100 may transmit the device data to the wired remote control device 40 using short-range wireless communication (response). The wired remote control device 40 displays the received device data on the display.

Figure 11:
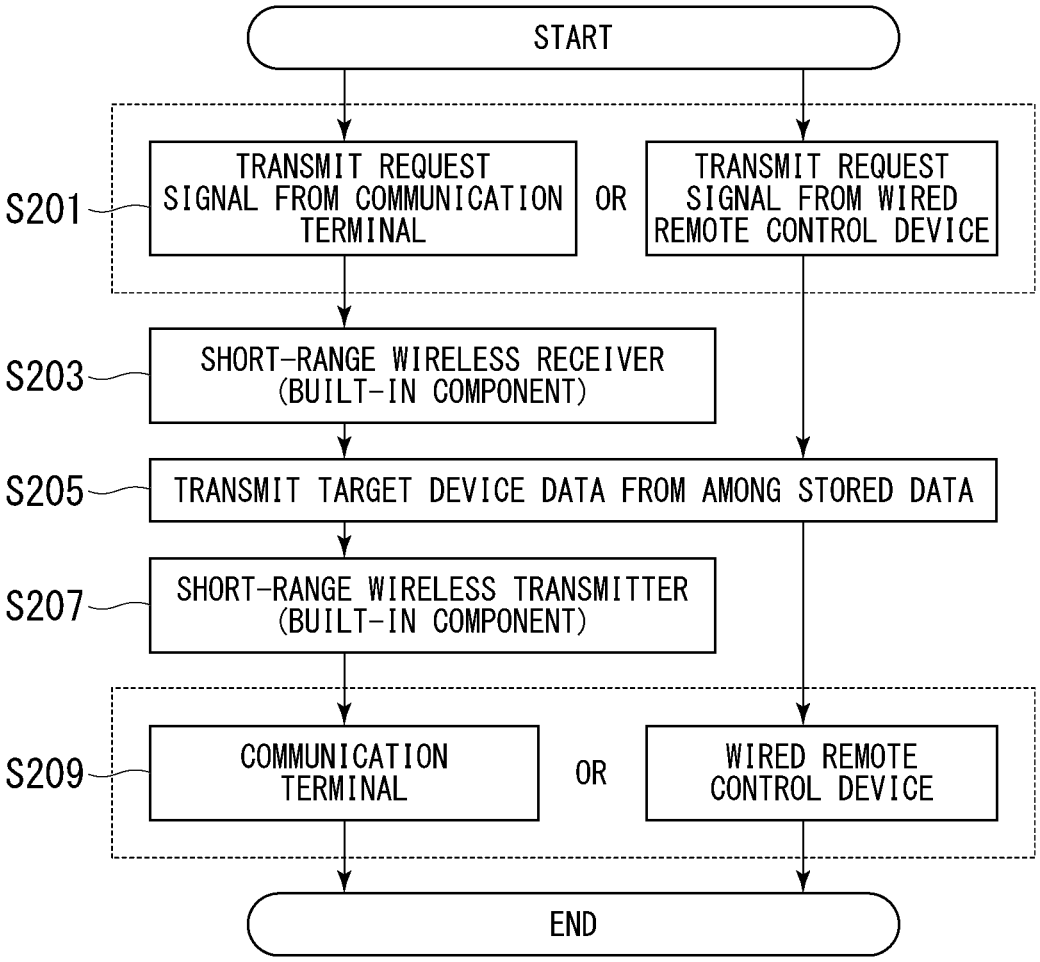
FIG. 11 is a flowchart showing an example of information collection processing for the air conditioning devices according to the third embodiment.

FIG. 11 is a flowchart showing an example of information collection processing for the air conditioning devices according to the present embodiment. The communication terminal 60 or the wired remote control device 40 transmits a request signal (step S201). In the case of the communication terminal 60, the communication terminal 60 transmits a request signal to the short-range wireless receiver WR using short-range wireless communication, and proceeds to step S203. For example, the short-range wireless receiver WR (transceiver 101) built in the system logger 100 receives the request signal (step S203), and proceeds to step S205. In the case of the wired remote control device 40, the wired remote control device 40 transmits a request signal to the system logger 100 using wired communication via the indoor unit 20, and proceeds to step S205.

Upon receiving the request signal from the communication terminal 60 or the wired remote control device 40, the system logger 100 transmits the latest requested device data among the collected device data already stored in the system logger 100 (step S205). When the request source is the communication terminal 60, the system logger 100 transmits the device data to the communication terminal 60 by short-range wireless communication via the short-range wireless transmitter WT (step S207), and proceeds to step S209. When the request source is the wired remote control device 40, the system logger 100 transmits the device data to the wired remote control device 40 by wired communication via the indoor unit 20, and proceeds to step S209.

Upon receiving the device data, the communication terminal 60 or the wired remote control device 40 displays the received device data on the display (step S209).

Figure 12:
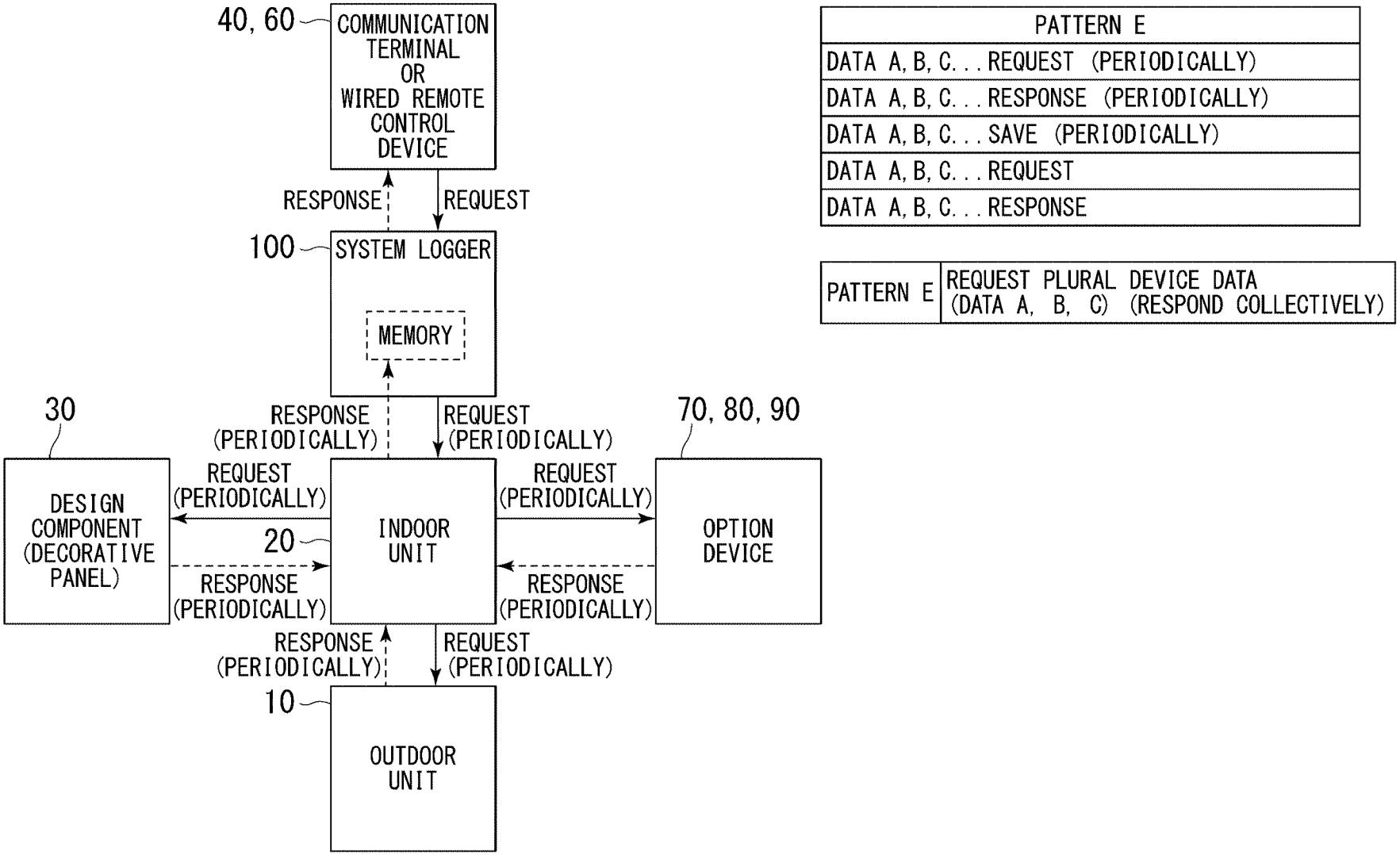
FIG. 12 is a diagram showing an example of a device data collection procedure according to the third embodiment.

FIG. 12 is a diagram showing an example of a device data collection procedure according to the present embodiment. Here, a device data collection procedure using the system logger 100 (pattern E) will be described.

The system logger 100 periodically collects device data of the outdoor unit 10, the indoor unit 20, the design components 30, and the option devices 70, 80, and 90. For example, the system logger 100 periodically transmits a request signal to the indoor unit 20. For example, this request signal is a request signal requesting collective acquisition of all data (data A, B, C, . . . ). Upon periodically receiving the request signal from the system logger 100, the indoor unit 20 each time transmits periodically to each of the outdoor unit 10, the design component 30, and the option devices 70, 80, and 90, the request signal requesting collective acquisition of the respective device data, and receives responses of the respective device data. The indoor unit 20 periodically transmits back to the system logger 100, all data (data A, B, C, . . . ) collectively including the device data of the own indoor unit 20 and the device data acquired from each of the outdoor unit 10, the design component 30, and the option devices 70, 80, and 90. The system logger 100 stores in memory of the system logger 100, all the data (data A, B, C, . . . ) periodically acquired.

Upon receiving a request signal requesting device data (data A, B, C, . . . ) from the communication terminal 60 or the wired remote control device 40, the system logger 100 collectively reads out the requested device data (data A, B, C, . . . ) from among the stored device data, and transmits the read device data to the communication terminal 60 or the wired remote control device 40 (response).

As described above, in the air conditioning management system 1B according to the present embodiment, the plurality of air conditioning devices include the system logger 100 (an example of an option device) which includes a memory configured to store various information acquired by short-range wireless communication. The system logger 100 is configured to periodically receive device data from each of the plurality of air conditioning devices and store the device data received in the memory. The communication terminal 60 is configured to transmit a request signal requesting the device data of each of the plurality of air conditioning devices. The system logger 100 that has received the request signal transmitted from the communication terminal 60 is configured to transmit the device data stored in the memory to the communication terminal 60.

As a result, according to the air conditioning management system 1B, the communication terminal 60 can acquire information on each air conditioning device, using short-range wireless communication, from the system logger 100 periodically storing the device data of the plurality of air conditioning devices such as the outdoor unit 10 and the indoor unit 20. Therefore, it is possible to acquire information on each device with a simple configuration, and suppress the time loss in acquiring the information.

Fourth Embodiment

Next, a fourth embodiment will be described.

Figure 13:
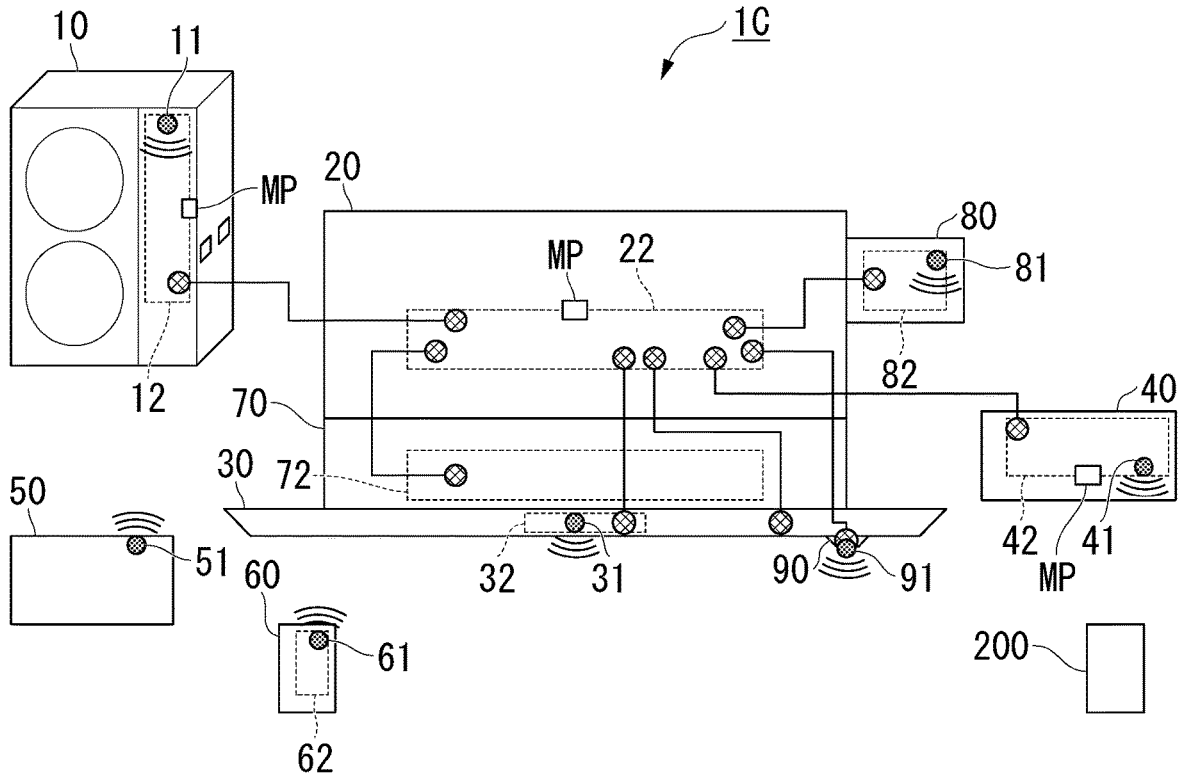
FIG. 13 is a block diagram showing a schematic configuration example of an air conditioning management system according to a fourth embodiment.

FIG. 13 is a block diagram showing a schematic configuration example of an air conditioning management system according to the present embodiment. Compared with the air conditioning management system 1A in FIG. 5, in an air conditioning management system 1C, any of the outdoor unit 10, the indoor unit 20, the design component 30, the option devices 70, 80, and 90, and the wired remote control device 40 includes a port MP that can perform recognition of, reading from, and writing into, an external storage medium 200. In the illustrated example, the port MP is included in each of the outdoor unit controller 12 of the outdoor unit 10, the indoor unit controller 22 of the indoor unit 20, and the remote controller 42 of the wired remote controller 40. Regardless of which port MP the external storage medium 200 is connected to, the device data of each of the outdoor unit 10, the indoor unit 20, the design component 30, and the option devices 70, 80, and 90 can be stored in the external storage medium 200 using wired communication.

For example, any storage medium such as a USB (Universal Serial Bus) memory or an SD card can be applied to the external storage medium 200. The port MP is an interface corresponding to a type of the external storage medium 200. For example, when the external storage medium 200 is a USB memory, the port MP is a USB port. Alternatively, when the external storage medium 200 is an SD card, the port MP is an SD card slot.

Figure 14:
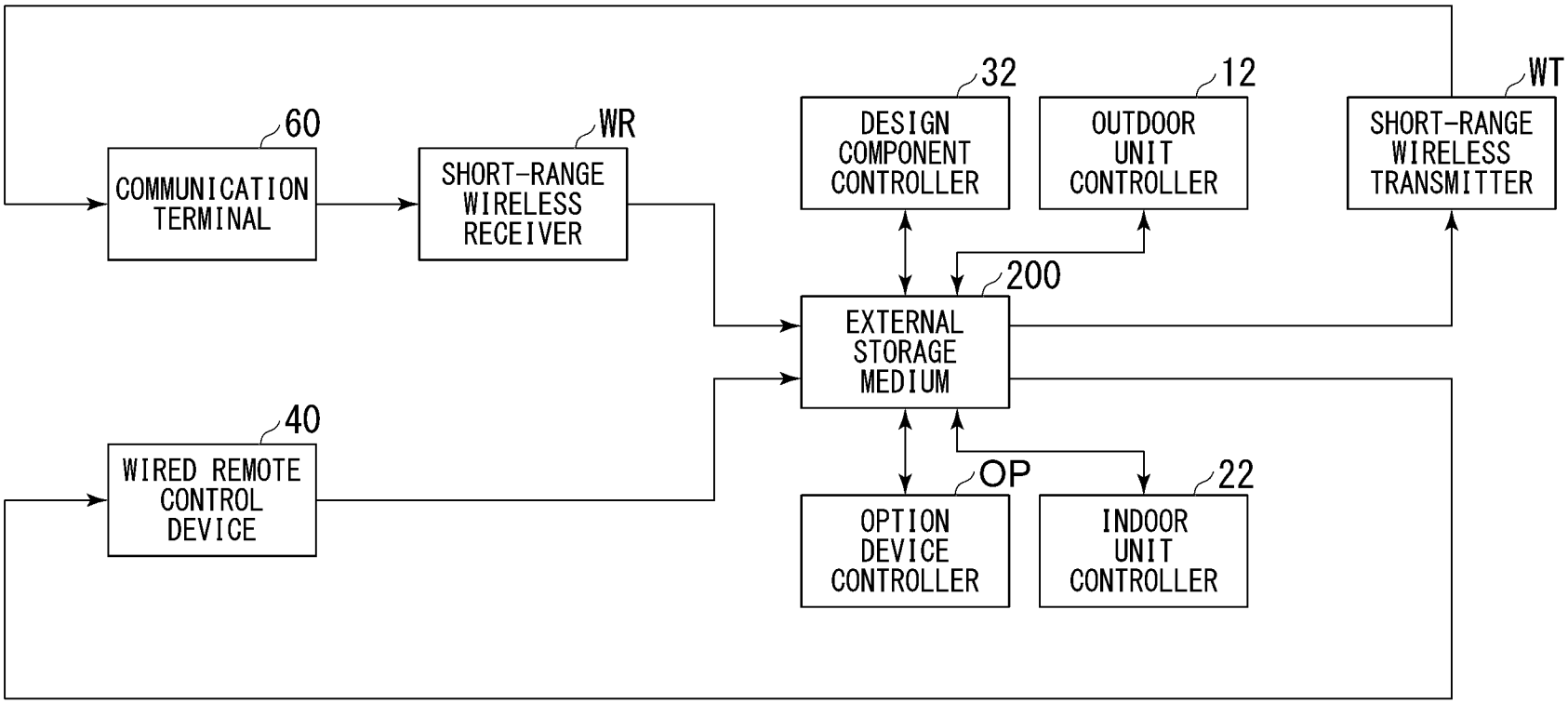
FIG. 14 is a functional block diagram showing an example of a functional configuration of air conditioning devices according to the fourth embodiment.

FIG. 14 is a functional block diagram showing an example of a functional configuration of the air conditioning devices according to the present embodiment. The functional configuration shown in FIG. 14 differs from the functional configuration shown in FIG. 6 in that device data of each air conditioning device is periodically stored in the external storage medium 200 via the port MP, and the external storage medium 200 responds to a request from the communication terminal 60 or the wired remote control device 40.

In response to a user operation or the like, the communication terminal 60 transmits, by short-range wireless communication, a request signal requesting device data. The request signal transmitted from the communication terminal 60 is received by the short-range wireless receiver WR. The short-range wireless receiver WR may be included in any of the transceiver 11 built in the outdoor unit 10, the transceiver 31 built in the design component 30, the transceiver 41 built in the wired remote control device 40, the transceiver 81 built in the option 80, and the transceiver 91 built in the option device 90. For example, the communication terminal 60 transmits a request signal via the short-range wireless receiver WR to the external storage medium 200 connected to the port MP of any of the air conditioning devices.

Further, in response to a user operation or the like, the wired remote control device 40 transmits a request signal requesting device data. For example, when the external storage medium 200 is connected to the port MP of the wired remote control device 40, the wired remote control device 40 directly transmits the request signal to the external storage medium 200 via the port MP. Here, when the external storage medium 200 is connected to the port MP of another air conditioning device such as the outdoor unit 10 or the indoor unit 20, the wired remote control device 40 transmits, using wired communication, a request signal to the external storage medium 200 connected to the port MP of the other air conditioning device.

In response to requests from air conditioning devices such as the outdoor unit controller 12, the indoor unit controller 22, the design component controller 32, and the option device controller OP, the external storage medium 200 connected via the port MP periodically acquires and stores device data of each air conditioning device. Here, the external storage medium 200 may acquire device data of the indoor unit 20 from the indoor unit controller 22, and also acquire device data from the outdoor unit controller 12, the design component controller 32, and the option device controller OP via the indoor unit controller 22.

Upon receiving a request signal from the communication terminal 60, the external storage medium 200 transmits to the communication terminal 60 via the short-range wireless transmitter WT, the latest requested device data among the stored acquired device data (response). The short-range wireless transmitter WT may be included in any of the transceiver 11 built in the outdoor unit 10, the transceiver 31 built in the design component 30, the transceiver 41 built in the wired remote control device 40, the transceiver 81 built in the option device 80, and the transceiver 91 built in the option device 90. The communication terminal 60 displays the received device data on the display.

Further, upon receiving a request signal from the wired remote control device 40, the external storage medium 200 transmits to the wired remote control device 40, the latest requested device data among the stored acquired device data (response). The wired remote control device 40 displays the received device data on the display.

In this way, it is possible to receive the latest requested device data among the acquired device data that has been stored, thereby reducing the time loss in acquiring information. Further, by removing the external storage medium 200 and connecting it to a personal computer, it is possible to check or copy the device data directly from the external storage medium 200 on the personal computer.

As described above, in the air conditioning management system 1C according to the present embodiment, one or more of the plurality of air conditioning devices is connectable to the external storage medium 200. The external storage medium 200 connected to any of the plurality of the air conditioning devices is configured to periodically receive and store the device data of each of the plurality of air conditioning devices, in response to a request from a respective one of the plurality of air conditioning devices. The communication terminal 60 is configured to transmit a request signal requesting the device data of each of the plurality of air conditioning devices. The external storage medium 200 is configured to transmit the device data stored to the communication terminal 60, in response to the request signal transmitted from the communication terminal 60.

As a result, according to the air conditioning management system 1C, the communication terminal 60 can acquire, using short-range wireless communication, information on each air conditioning device from the external storage medium 200 periodically storing device data of air conditioning devices such as the outdoor unit 10 and the indoor unit 20. Therefore, it is possible to acquire information on each device with a simple configuration, and suppress the time loss in acquiring the information.

Further, in the air conditioning management system 1C, although mounting space is necessary to secure a port MP to be connected to the external storage medium 200, there is little effect on the size of the devices such as the outdoor unit 10 and the indoor unit 20. Further, the external storage medium 200 owned by the user can also be used, thereby reducing the cost for mounting memory. According to the present embodiment, it is possible to easily use the large-capacity external storage medium 200 which is easily removable, so that operating data, software information, backup data, and the like of the air conditioning devices can be periodically collected and stored, and also retrieved not only by the communication terminal 60, but also by a personal computer of a person in charge of service, thereby improving convenience for service personnel.

As described above, each of the embodiments has been described in detail with reference to the drawings, but the specific configuration is not limited to these embodiments, and each embodiment may be combined, modified, or omitted as appropriate.

In the above embodiments, instead of the communication terminal 60, the wireless remote control device 50 can also be applied as the communication terminal of the present disclosure. Further, in the above embodiments, the wired remote control device 40 has been described as a device that performs transmission of request signals and reception of device data using wired communication. However, since the wired remote control device 40 also supports short-range wireless communication, the wired remote control device 40, instead of the communication terminal 60, can also be applied as the communication terminal of the present disclosure.

Further, in the above embodiments, the configuration example in which one indoor unit 20 is connected to the outdoor unit 10 is shown, but the number of indoor units 20 is not limited to one, and may be plural. For example, as the indoor unit 20 in the above embodiments, one of a plurality of indoor units may collect device data of other air conditioning devices.

Further, the air conditioning device that collects device data is not limited to the indoor unit 20, and may be the outdoor unit 10, the wired remote control device 40, or an option device.

Here, a program for realizing the functions of the controller of each air conditioning device may be recorded in a computer-readable recording medium, so that a computer system can read and execute the program recorded in the recording medium to perform the processing of the controller of each air conditioning device. Here, the "computer system" referred to here includes an OS and hardware such as peripheral devices.

Further, the "computer-readable recording medium" refers to portable media such as flexible disks, magneto-optical disks, ROMs and CD-ROMs, and storage devices such as hard disks built into computer systems. Further, the "computer-readable recording medium" includes: a medium that dynamically retains a program for a short period of time, such as a communication line in a case where the program is transmitted via a network such as the Internet or a communication line such as a telephone line; and a medium that retains a program for a certain period of time, such as a volatile memory inside a computer system that serves as a server or a client in the above case. Further, the above-described program may be one for realizing part of the functions described above, or may be one capable of realizing the functions described above in combination with a program already recorded in the computer system. Further, the above-described program may be stored in a predetermined server, so that it will be distributed (downloaded, or the like) via a communication line in response to a request from another device.

Further, part or all of the functions of each air conditioning device may be implemented as an integrated circuit such as an LSI (Large Scale Integration). Each function may be individually processorized, and part or all of the functions may be integrated and processorized. Further, the integrated circuit is not limited to an LSI, and may be implemented as a dedicated circuit or a general-purpose processor. Further, when an integrated circuit technology that replaces the LSI appears due to advances in semiconductor technology, an integrated circuit based on that technology may be used.

The invention claimed is:

1. An air conditioning management system comprising:

an air conditioning system comprising a plurality of air conditioning devices; and a communication terminal capable of performing short-range wireless communication with at least one of the plurality of air conditioning devices, wherein the plurality of air conditioning devices include an outdoor unit, an indoor unit, a remote control device, and an option device connected to at least one of the outdoor unit, the indoor unit and the remote control device, the outdoor unit, the indoor unit, and the remote control device are capable of performing wired communication, each air conditioning device of the plurality of air conditioning devices comprises a transceiver configured to, in response to receiving a request signal requesting device data, transmit device data of the air conditioning device to another air conditioning device or the communication terminal, the communication terminal comprises a transmitter configured to transmit by the short-range wireless communication, the request signal to one of the plurality of air conditioning devices, and a receiver configured to receive by the short-range wireless communication, the device data transmitted in response to the request signal, the communication terminal is configured to transmit a first request signal requesting device data that includes device data of the option device, a first air conditioning device that receives the first request signal, among the plurality of air conditioning devices, is configured to forward the first request signal to other air conditioning devices including the option device, each of the other air conditioning devices is configured to transmit the device data of a respective one of the other air conditioning devices to the first air conditioning device, in response to receiving the first request signal forwarded from the first air conditioning device, and the first air conditioning device is configured to transmit to the communication terminal, the device data received and the device data of the first air conditioning device.

2. The air conditioning management system according to claim 1, wherein the option device comprises a memory configured to store various information acquired by short-range wireless communication, the option device is configured to periodically receive device data from each of the plurality of air conditioning devices and store the device data received in the memory, the communication terminal is configured to transmit a second request signal requesting the device data of each of the plurality of air conditioning devices, and the option device that receives the second request signal is configured to transmit the device data stored in the memory to the communication terminal.

3. An air conditioning management system comprising:

an air conditioning system comprising a plurality of air conditioning devices; and a communication terminal capable of performing short-range wireless communication with at least one of the plurality of air conditioning devices, wherein the plurality of air conditioning devices include an outdoor unit, an indoor unit, a remote control device, and an option device connected to at least one of the outdoor unit, the indoor unit, and the remote control device, the outdoor unit, the indoor unit, and the remote control device are capable of performing wired communication, the option device is capable of performing short-range wireless communication, each air conditioning device of the plurality of air conditioning devices comprises a transceiver configured to, in response to receiving a request signal requesting device data, transmit device data of the air conditioning device to another air conditioning device or the communication terminal, the communication terminal comprises a transmitter configured to transmit by the short-range wireless communication, the request signal to one of the plurality of air conditioning devices, and a receiver configured to receive by the short-range wireless communication, the device data transmitted in response to the request signal, the communication terminal is configured to transmit a first request signal requesting device data that includes device data of the option device, the option device that receives the first request signal is configured to forward the first request signal to other air conditioning devices than the option device, in response to receiving the first request signal, each of the other air conditioning devices is configured to transmit the device data of a respective one of the other air conditioning devices to the option device, in response to receiving the first request signal forwarded from the option device, and the option device is configured to transmit to the communication terminal, the device data received and the device data of the option device.

4. The air conditioning management system according to claim 3, wherein the option device comprises a memory configured to store various information acquired by short-range wireless communication, the option device is configured to periodically receive device data from each of the plurality of air conditioning devices and store the device data received in the memory, the communication terminal is configured to transmit a second request signal requesting the device data of each of the plurality of air conditioning devices, and the option device that receives the second request signal is configured to transmit the device data stored in the memory to the communication terminal.

5. An air conditioning management method for an air conditioning system comprising a plurality of air conditioning devices which include an outdoor unit, an indoor unit, a remote control device, and an option device connected to at least one of the outdoor unit, the indoor unit, and the remote control device, the air conditioning management method comprising:

receiving, by a first air conditioning device among the plurality of air conditioning devices, from a communication terminal, a first request signal requesting device data that includes device data of the option device;

forwarding, by the first air conditioning device, the first request signal to other air conditioning devices including the option device;

receiving, by the first air conditioning device, from each of the other air conditioning devices, the device data of a respective one of the other air conditioning devices; and transmitting, by the first air conditioning device, to the communication terminal, the device data received and the device data of the first air conditioning device.

6. The air conditioning management method according to claim 5, further comprising:

periodically receiving, by the option device, device data from each of the plurality of air conditioning devices;

storing, by the option device, the device data received in a memory of the option device;

receiving, by the option device, from the communication terminal, a second request signal requesting the device data of each of the plurality of air conditioning devices; and transmitting, by the option device, the device data stored in the memory to the communication terminal.

* * * * *